US008862046B2

(12) United States Patent
Ichiki et al.

(10) Patent No.: US 8,862,046 B2
(45) Date of Patent: Oct. 14, 2014

(54) SHEET PRESSING DEVICE AND IMAGE FORMING APPARATUS

(75) Inventors: Yukihiro Ichiki, Kanagawa (JP); Yasuki Tanaka, Kanagawa (JP); Motoyuki Yagi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 427 days.

(21) Appl. No.: 12/874,245

(22) Filed: Sep. 2, 2010

(65) Prior Publication Data

US 2011/0211873 A1 Sep. 1, 2011

(30) Foreign Application Priority Data

Feb. 26, 2010 (JP) ..... 2010-042424

(51) Int. Cl.
*G03G 15/00* (2006.01)

(52) U.S. Cl.
CPC .. *G03G 15/6576* (2013.01); *G03G 2215/00662* (2013.01)
USPC ..... 399/406; 399/405; 399/397; 399/400

(58) Field of Classification Search
CPC ..... G03G 15/6576; G03G 2215/00662; B65H 15/00; B65H 85/00; B65H 29/70; B65H 2301/5121; B65H 2301/51256
USPC ..... 399/406, 405, 401, 400, 397, 322, 122, 399/316, 317, 323, 398, 399; 271/209, 161, 271/279, 188
See application file for complete search history.

(56) References Cited

U.S. PATENT DOCUMENTS

| | | | | |
|---|---|---|---|---|
| 7,532,855 | B2 * | 5/2009 | Kajita | 399/406 |
| 7,992,861 | B2 * | 8/2011 | Furuya et al. | 271/125 |
| 8,100,400 | B2 * | 1/2012 | Seki | 271/188 |
| 2008/0131177 | A1 * | 6/2008 | Aratachi et al. | 399/323 |
| 2008/0219732 | A1 * | 9/2008 | Hattori | 399/397 |
| 2008/0298874 | A1 * | 12/2008 | Yoon | 400/642 |

FOREIGN PATENT DOCUMENTS

| | | |
|---|---|---|
| JP | 4-88457 | 7/1992 |
| JP | 06-127742 A | 5/1994 |
| JP | 06-202506 A | 7/1994 |

(Continued)

OTHER PUBLICATIONS

Notification of Reasons for Refusal dated Oct. 4, 2013, issued by the Japanese Patent Office in Application No. 2010-042424.

(Continued)

*Primary Examiner* — Ren Yan
*Assistant Examiner* — John M Royston
(74) *Attorney, Agent, or Firm* — Sughrue Mion, PLLC

(57) ABSTRACT

A sheet pressing device includes plurality of pressing members and a support member. The plurality of pressing members is provided on a downstream side in a discharging direction of fixing unit which carries out a fixing treatment over a sheet having an unfixed image transferred thereonto along the discharging direction. The plurality of pressing members presses both ends of the sheet in a direction along a surface of the sheet carried out the fixing treatment by the fixing unit and in a direction crossing the discharging direction. The support member supports the plurality of pressing members movably in such a direction as to approach or separate from the sheet when the sheet passes through the sheet pressing device.

7 Claims, 12 Drawing Sheets

(56) References Cited

FOREIGN PATENT DOCUMENTS

| | | | | |
|---|---|---|---|---|
| JP | 08-040621 | | | 2/1996 |
| JP | 2000-047443 | | | 2/2000 |
| JP | 2001154519 | A | * | 6/2001 |
| JP | 2003-208057 | | | 7/2003 |
| JP | 2005-041635 | A | | 2/2005 |
| JP | 2006-082948 | | | 3/2006 |
| JP | 2009-156991 | A | | 7/2009 |

OTHER PUBLICATIONS

Notification of the First Office Action dated May 19, 2014, issued by the State Intellectual Property Office of the People's Republic of China in Application No. 201010513920.5.

Notification of Reasons for Refusal dated May 29, 2014, issued by the Japanese Patent Office in Application No. 2010-042424.

* cited by examiner

SHEET PRESSING DEVICE AND IMAGE FORMING APPARATUS

CROSS-REFERENCE TO RELATED APPLICATION

This application is based on and claims priority under 35 U.S.C. 119 from Japanese Patent Application No. 2010-042424 filed on Feb. 26, 2010.

BACKGROUND

1. Technical Field

The present invention relates to a sheet pressing device and an image forming apparatus.

2. Related Art

In the image forming apparatus, when an unfixed toner image transferred onto a recording paper is to be fixed by a fixing device, the recording paper having the unfixed toner image transferred thereonto is heated and pressurized by the fixing device. For this reason, it has been known that a deformation referred to as a so-called "side curl" in which a tip side in a delivering direction of the recording paper is curved in a direction crossing the delivering direction occurs depending on a structure of the fixing device or a moisture state of the recording paper.

SUMMARY

According to an aspect of the invention, a sheet pressing device includes plurality of pressing members and a support member. The plurality of pressing members is provided on a downstream side in a discharging direction of the fixing unit which carries out a fixing treatment over a sheet having an unfixed image transferred thereonto along the discharging direction. The plurality of pressing members presses both ends of the sheet in a direction along a surface of the sheet carried out the fixing treatment by the fixing unit and in a direction crossing the discharging direction. The support member supports the plurality of pressing members movably in such a direction as to approach or separate from the sheet when the sheet passes through the sheet pressing device.

BRIEF DESCRIPTION OF THE DRAWINGS

Exemplary embodiments of the invention will be described in detail based on the following figures, wherein.

DETAILED DESCRIPTION

Embodiments according to the invention will be described below with reference to the drawings.

Figure 2:
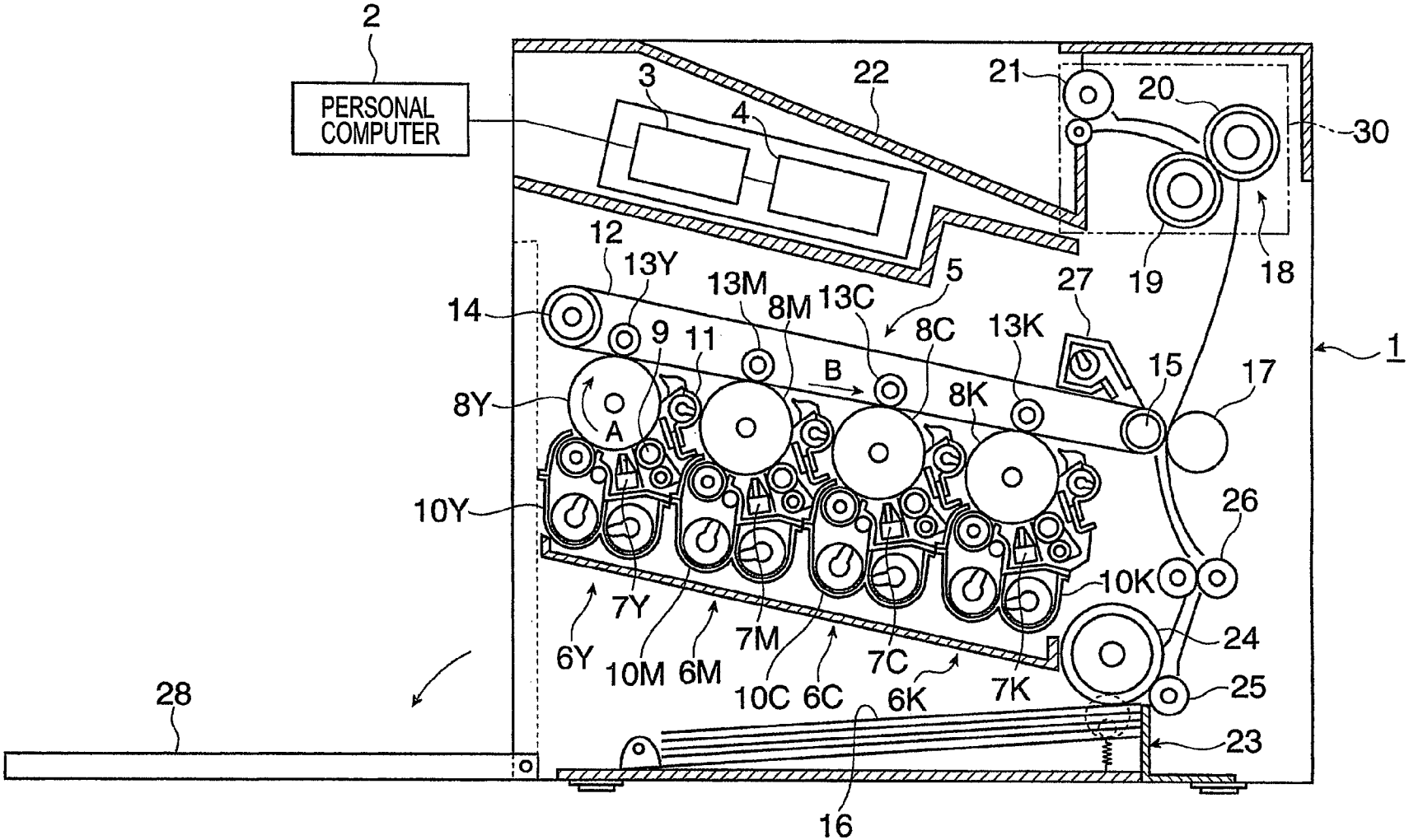
FIG. 2 is a view showing a structure of a color printer of a tandem type which serves as an image forming apparatus applying a sheet pressing device according to the embodiment of the invention.
Figure 3:
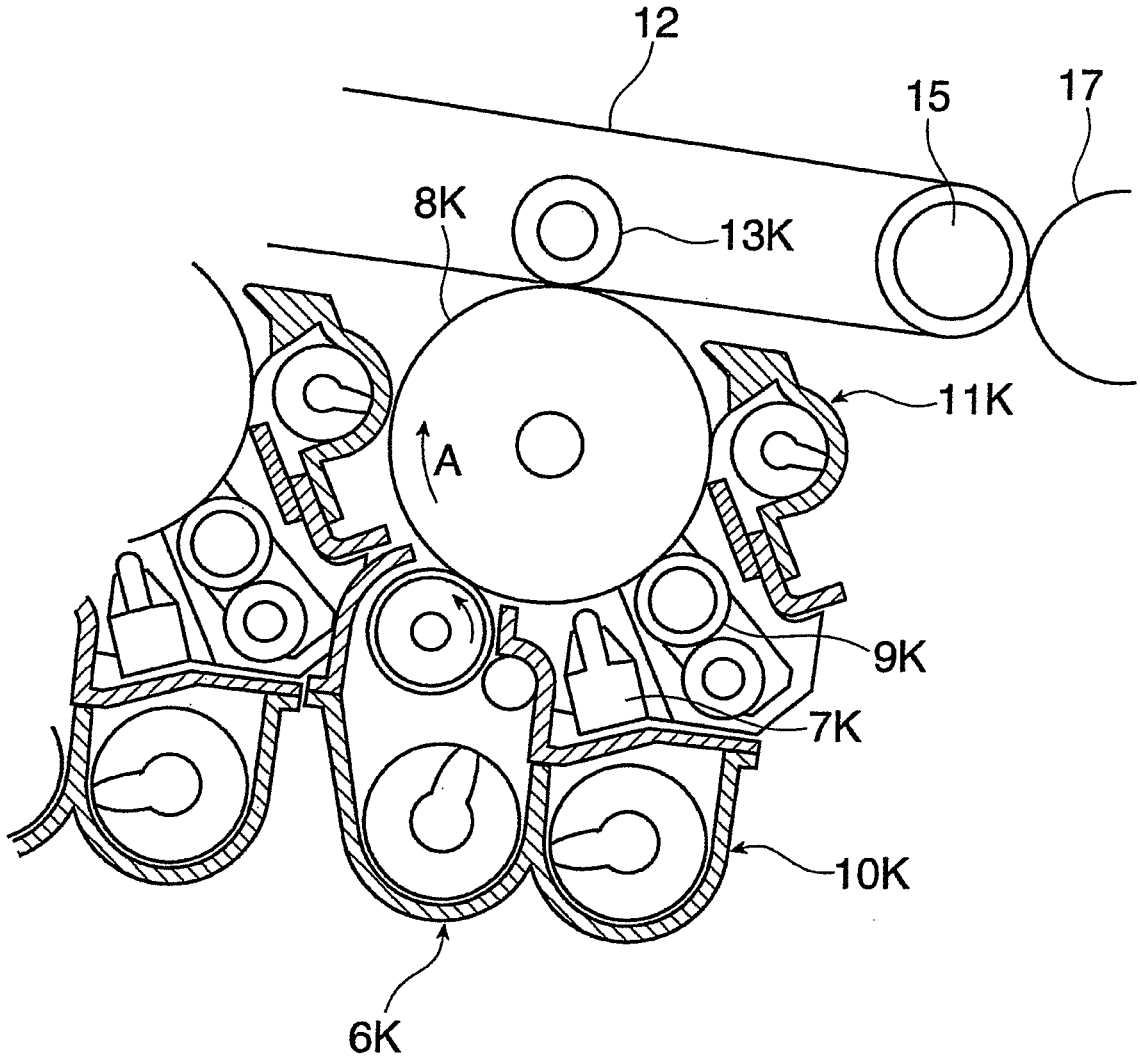
FIG. 3 is a view showing a structure of an image forming portion of the color printer of the tandem type which serves as the image forming apparatus applying the sheet pressing device according to the embodiment of the invention.

FIG. 2 is a view showing a structure of a color printer of a tandem type which serves as an image forming apparatus applying a sheet pressing device according to a embodiment of the invention. Moreover, FIG. 3 is a view showing a structure of an image forming portion of the color printer.

As shown in FIG. 2, the color printer serves to output a full color or monochrome image depending on image data output from a personal computer or an image reading device which is not shown or image data transferred through a telephone line or a LAN.

As shown in FIG. 2, a color printer body 1 includes an image processing portion 3 for carrying out a predetermined image processing such as a shading correction, a positional shift correction, a lightness/color space conversion, a gamma correction, a frame erasure or a color/movement edit over image data transferred from a personal computer (PC) 2 or an image reading device (not shown) if necessary, and a control portion 4 for controlling an operation of the whole color printer.

The image data subjected to the predetermined image processing by the image processing portion 3 as described above are also converted into image data having four colors of yellow (Y), magenta (M), cyan (C) and black (K) by the image processing portion 3 and are output as a full color image or a monochrome image by an image output portion 5 provided in the color printer body 1 as will be described below.

The image data converted into the image data having the four colors of the yellow (Y), the magenta (M), the cyan (C) and the black (K) by the image processing portion 3 are transmitted to image exposing devices 7Y, 7M, 7C and 7K of image forming units 6Y, 6M, 6C and 6K for the colors of the yellow (Y), the magenta (M), the cyan (C) and the black (K). In the image exposing devices 7Y, 7M, 7C and 7K, an image is exposed by a light emitted from an LED light emitting device array depending on the image data on a corresponding one of the colors.

As shown in FIG. 2, in the color printer body 1, the four image forming units (image forming portions) 6Y, 6M, 6C and 6K for the yellow (Y), the magenta (M), the cyan (C) and the black (K) are disposed in parallel at a certain interval in a state in which they are tilted by a predetermined angle (for example, approximately 10 degrees) to a horizontal direction such that the image forming unit 6Y for the yellow (Y) to be a first color is relatively high and the image forming unit 6K for the black (K) to be a final color is relatively low. As a matter of course, tilt angles of the image forming units 6Y, 6M, 6C and 6K are not restricted to approximately 10 degrees but may be greater or smaller.

By disposing the four image forming units 6Y, 6M, 6C and 6K for the yellow (Y), the magenta (M), the cyan (C) and the black (K) in a tilting state at a predetermined angle, thus, it is possible to set a distance among the image forming units 6Y, 6M, 6C and 6K to be shorter as compared with the case in which the four image forming units 6Y, 6M, 6C and 6K are provided horizontally. Consequently, it is possible to decrease a width of the color printer body 1, thereby reducing a size still more.

The four image forming units 6Y, 6M, 6C and 6K basically have the same structures except for a color of an image to be formed, and are roughly constituted by a photosensitive drum 8 serving as an image holding member to be rotated and driven at a predetermined speed in a direction of an arrow A by driving means which is not shown, a charging roll 9 for primary charging which uniformly charges a surface of the photosensitive drum 8, the image exposing device 7 including an LED print head for exposing a corresponding image to a predetermined color to form an electrostatic latent image on the surface of the photosensitive drum 8, a developing device 10 for developing the electrostatic latent image formed on the photosensitive drum 8 with a toner having a predetermined color, and a cleaning device 11 for cleaning the surface of the photosensitive drum 8 as shown in FIGS. 2 and 3.

The photosensitive drum 8 to be used is formed like a drum having a diameter of approximately 30 mm and has a surface coated with a photosensitive layer constituted by an organic photoconductor (OPC), for example, and is rotated and driven at a predetermined speed in the direction of the arrow A by means of a driving motor which is not shown.

For the charging roll 9, moreover, there is used a roll-shaped charger obtained by coating a surface of a core bar with a conductive layer constituted by a synthetic resin or a synthetic rubber and having an electric resistance regulated, for example, and a predetermined charging bias is applied to the core bar of the charging roll 9.

The image exposing device 7 is individually disposed for each of the four image forming units 6Y, 6M, 6C and 6K as shown in FIG. 2, and the image exposing device 7 provided in each of the image forming units 6Y, 6M, 6C and 6K which is to be used includes an LED light emitting device array in which LED light emitting devices are disposed rectilinearly in an axial direction of the photosensitive drum 8 at a predetermined pitch (for example, 600 dpi to 1200 dpi) and a rod lens array in which an image of a light emitted from each of the LED light emitting devices of the LED light emitting device array is formed like a spot on the photosensitive drum 8. Moreover, the image exposing device 7 is constituted to scan and expose an image onto the photosensitive drum 8 from below as shown in FIGS. 2 and 3.

In the case in which the image exposing device 7 constituted by the LED light emitting device array is used, a size of the image exposing device can be reduced considerably, which is desirable. However, the image exposing device 7 is not restricted to the LED light emitting device array but it is also possible to use an image exposing device which deflects and scans a laser beam in the axial direction of the photosensitive drum 8. In this case, the single image exposing device 7 is disposed for the four image forming units 6Y, 6M, 6C and 6K.

Image data on corresponding colors are sequentially output from the image processing portion 3 to the image exposing devices 7Y, 7M, 7C and 7K provided individually in the image forming units 6Y, 6M, 6C and 6K for the respective colors of the yellow (Y), the magenta (M), the cyan (C) and the black (K) as described above, and luminous fluxes emitted depending on the image data from the image exposing devices 7Y, 7M, 7C and 7K are scanned and exposed onto surfaces of photosensitive drums 8Y, 8M, 8C and 8K corresponding thereto so that electrostatic latent images depending on the image data are formed. The electrostatic latent images formed on the photosensitive drums 8Y, 8M, 8C and 8K are developed as toner images for the respective colors of the yellow (Y), the magenta (M), the cyan (C) and the black (K) by developing devices 10Y, 10M, 10C and 10K, respectively.

The toner images for the respective colors of the yellow (Y), the magenta (M), the cyan (C) and the black (K) formed sequentially on the photosensitive drums 8Y, 8M, 8C and 8K of the image forming units 6Y, 6M, 6C and 6K are primarily transferred sequentially in multiple ways by means of four primary transfer rolls 13Y, 13M, 13C and 13K onto an intermediate transfer belt 12 serving as a non-end belt-shaped intermediate transfer member which is disposed in a tilting state above the image forming units 6Y, 6M, 6C and 6K.

The intermediate transfer belt 12 is a non-end belt-shaped member which is laid with a tension by means of a plurality of rolls, and is disposed in a tilting state to a horizontal direction in such a manner that a lower side running region of the belt-shaped member has downstream and upstream sides in a running direction which are relatively low and high, respectively.

In other words, as shown in FIG. 2, the intermediate transfer belt 12 is laid with a certain tension between a driving roll 15 having a function for a back support roll of a secondary transfer portion and a driven roll 14, and is circulated and driven at a predetermined speed in a direction of an arrow B by means of the driving roll 15 to be rotated and driven by a driving motor (not shown) which is excellent in a constant speed stability. There is used the intermediate transfer belt 12 which is formed like a non-end belt by a synthetic resin film such as polyimide or polyamide-imide which has a flexibility, for example. The intermediate transfer belt 12 is disposed in contact with the photosensitive drums 8Y, 8M, 8C and 8K of the image forming units 6Y, 6M, 6C and 6K in the low side running region.

As shown in FIG. 2, moreover, a secondary transfer roll 17 to be secondary transfer means is disposed on the intermediate transfer belt 12 in contact with a surface of the intermediate transfer belt 12 laid with the tension by the driving roll 15. The secondary transfer roll 17 is provided on an end at a lower position side in the running region of the intermediate transfer belt 12 and serves to secondarily transfer, onto a recording medium 16, the toner image transferred primarily onto the intermediate transfer belt 12.

The toner images for the respective colors of the yellow (Y), the magenta (M), the cyan (C) and the black (K) transferred onto the intermediate transfer belt 12 in the multiple way are secondarily transferred onto the recording paper 16 to be a sheet by means of the secondary transfer roll 17 coming in contact with the driving roll 15 through the intermediate transfer belt 12, and the recording paper 16 having the toner images for the respective colors transferred thereonto is delivered to a fixing device 18 positioned above in a vertical direction as shown in FIG. 2. The secondary transfer roll 17 is provided in pressure contact with a side of the driving roll 15 through the intermediate transfer belt 12, and serves to secondarily transfer the toner images for the respective colors in a lump onto the recording paper 16 delivered upward in the vertical direction.

For example, the secondary transfer roll 17 to be used is obtained by coating, in a predetermined thickness, an outer periphery of a core bar formed of a metal such as stainless with an elastic layer constituted by a conductive elastic member such as a synthetic rubber material to which a conductive agent is added.

The recording paper 16 having the toner images for the respective colors transferred thereonto is subjected to a fixing treatment by heat and pressure through a heating roll 19 and a pressurizing belt (or a pressurizing roll) 20 in the fixing device 18 serving as fixing unit, and is then discharged onto a discharging tray 22 provided on an upper end of the printer body 1 by means of a discharging roll 21 in a state in which an image surface is turned downward.

As shown in FIG. 2, the recording papers 16 which are formed by a predetermined material in a predetermined size are fed from a paper feeding tray 23 disposed in a bottom part of the printer body 1 in a state in which they are separated one by one by means of a paper feeding roll 24 and a paper separating roll 25, and are once delivered to a resist roll 26 and are stopped. Then, the recording paper 16 supplied from the paper feeding tray 23 is fed to a secondary transfer position of the intermediate transfer belt 12 by means of the resist roll 26 rotated in a predetermined timing. For the recording paper 16, it is possible to supply a thick paper such as a coat paper subjected to a coating treatment over a surface or both the surface and a back face and an OHP sheet in addition to a plain paper, and a photographic image is also output to the recording paper 16 constituted by the coat paper.

In that case, for example, the recording paper 16 is fed and delivered with a central part in a direction crossing a paper feeding direction set to be a reference and the toner image is transferred and fixed from the intermediate transfer belt 12, and similarly, is discharged onto the discharging tray 22 with the central part in the direction crossing the paper feeding direction set to be the reference. The invention is not always restricted thereto but it is also possible to employ a structure in which the recording paper 16 is fed and delivered with one of ends in the direction crossing the paper feeding direction set to be the reference, for example.

As shown in FIGS. 2 and 3, a residual toner is removed by the cleaning device 11 from the surface of the photosensitive drum 8 subjected to the primary transferring step for the toner image to prepare for a next image forming step. As shown in FIG. 2, moreover, a residual toner is removed from the surface of the intermediate transfer belt 12 subjected to the secondary transferring step for the toner image by means of a belt cleaning device 27 provided in the vicinity on a downstream side of the driving roll 15 to prepare for a next image forming step.

Figure 1:
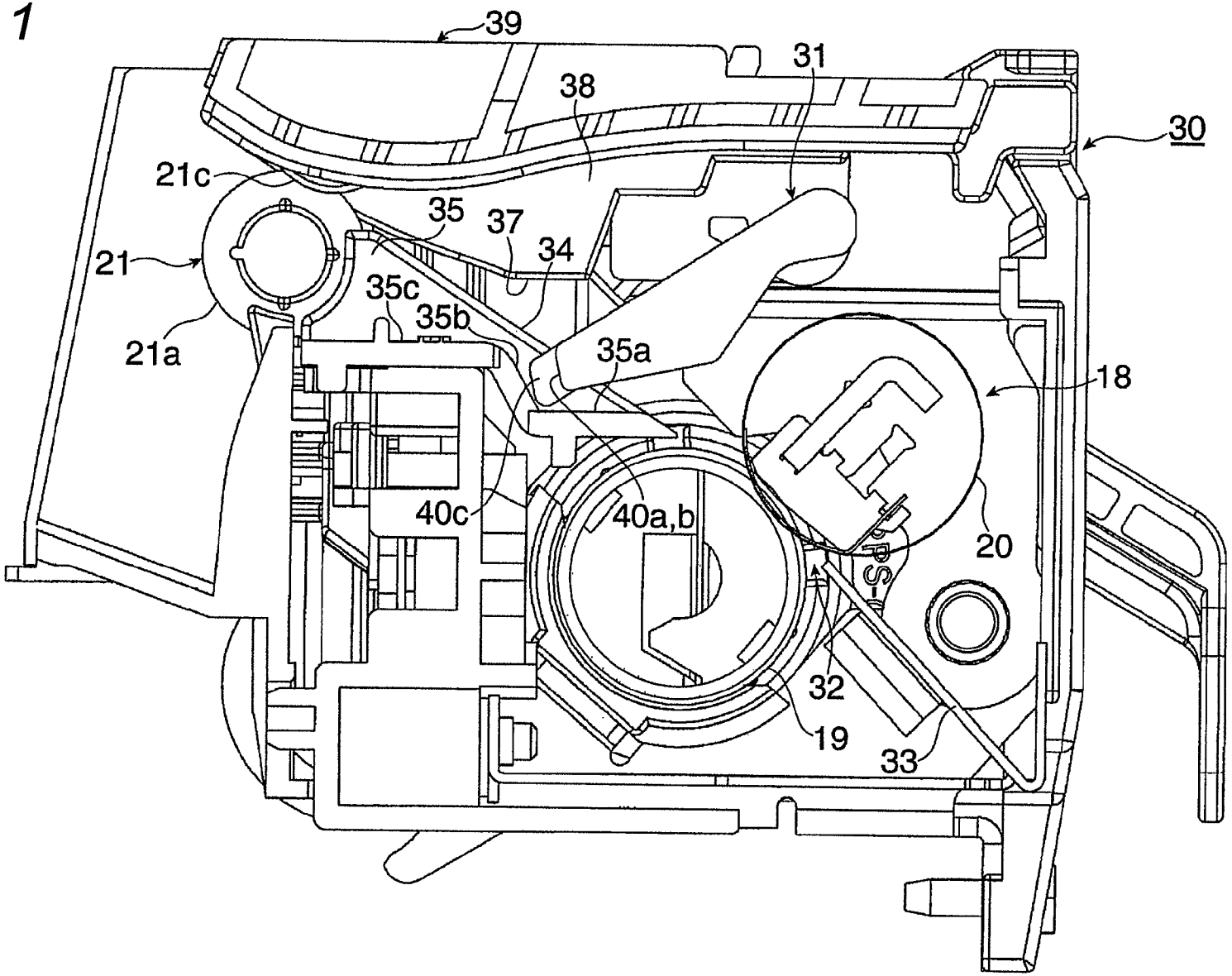
FIG. 1 is a view showing a sectional structure of a fixing unit to which a sheet pressing member is applied according to an embodiment of the invention.

FIG. 1 is a view showing a sectional structure of a fixing unit applying the sheet pressing device according to the embodiment of the invention.

Figure 4:
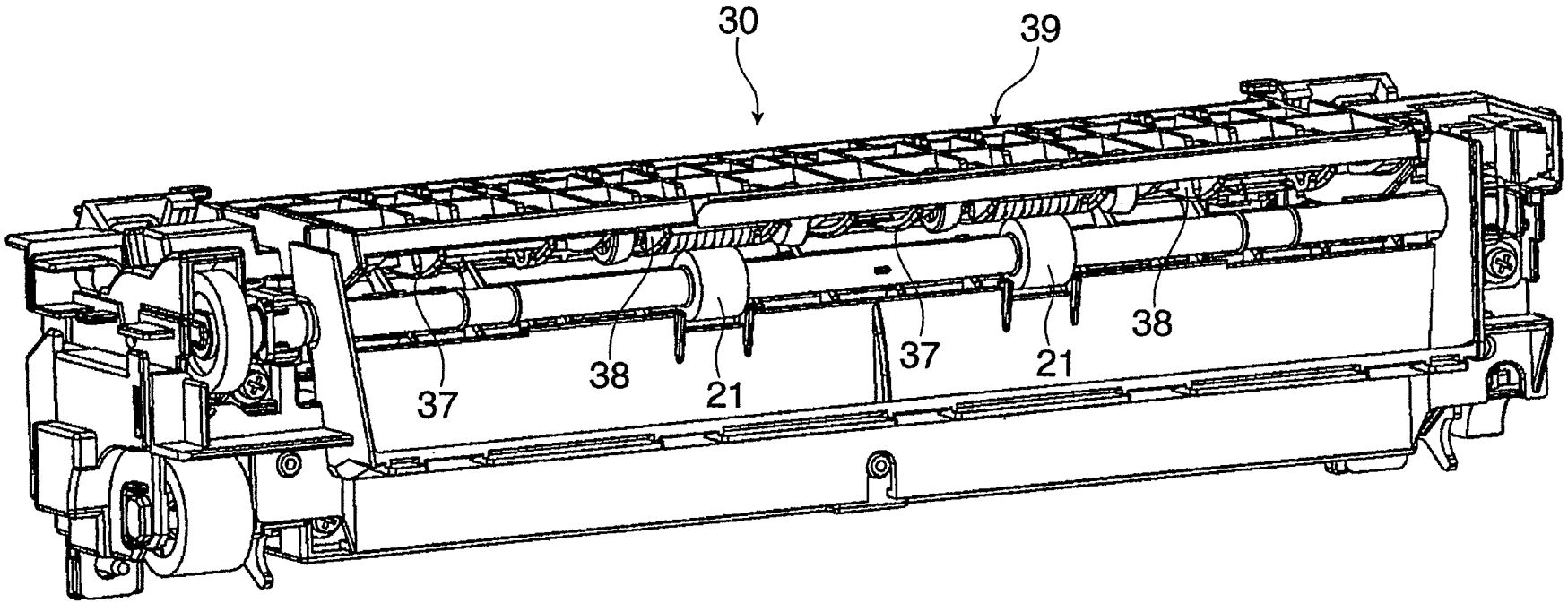
FIG. 4 is a perspective view showing an appearance of a fixing unit.

As shown in FIG. 4, a fixing unit 30 is formed as an independent unit and is constituted removably from the printer body 1. As shown in FIG. 1, the discharging roll 21 and a sheet pressing device 31 according to the embodiment are attached to the fixing unit 30 in addition to the fixing device 18. The discharging roll 21 serves to discharge, onto the discharging tray 22, the recording paper 16 subjected to the fixing treatment by the fixing device 18.

Figure 5:
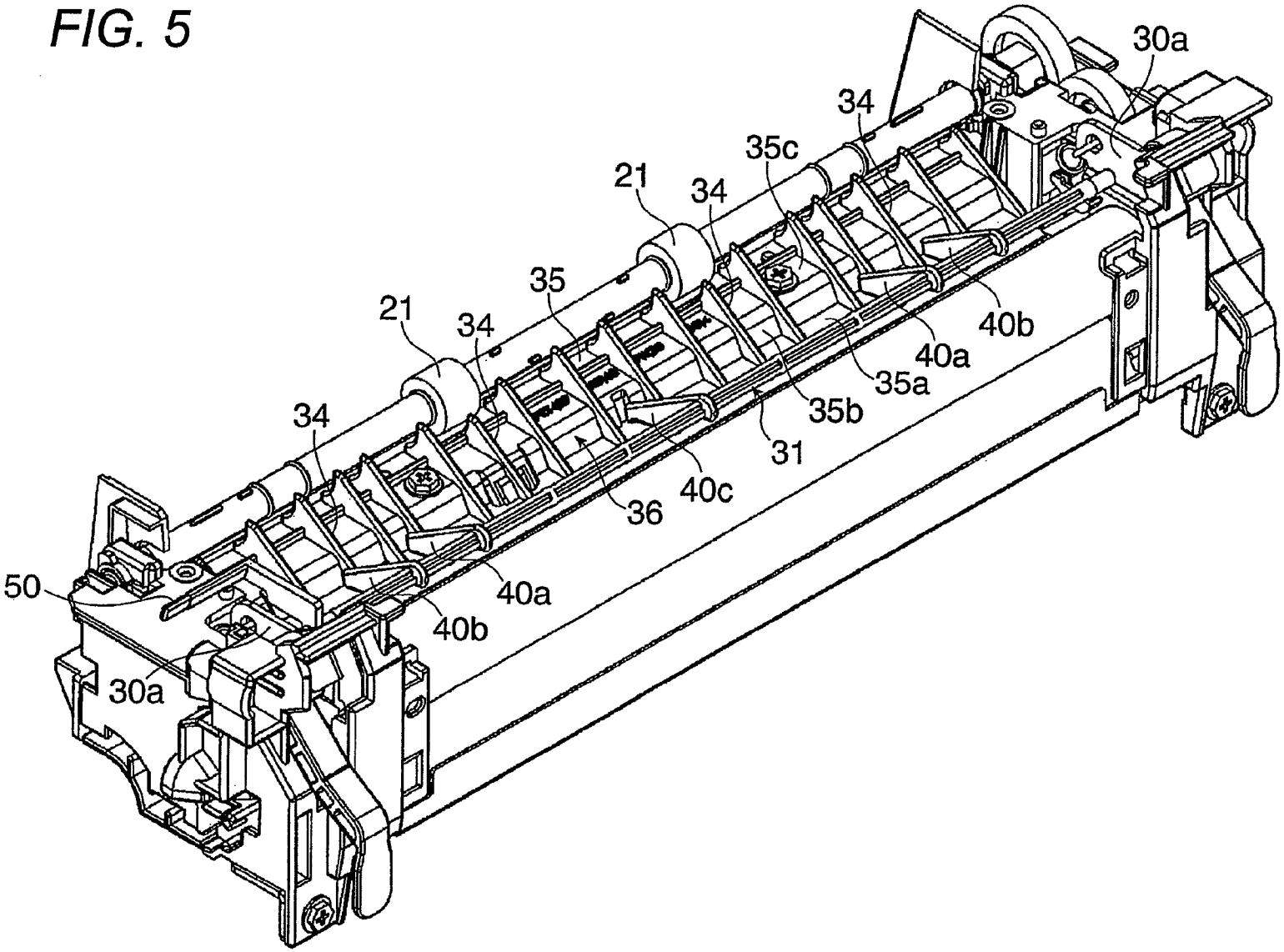
FIG. 5 is a perspective view showing the appearance of the fixing unit.

As shown in FIG. 2, the recording paper 16 is delivered to the fixing unit 30. A full color toner image is secondarily transferred to the recording paper 16 in a secondary transfer position of the intermediate transfer belt 12. As shown in FIG. 1, a plate-shaped inlet side guiding member 33 is provided in an inlet portion of the fixing device 18. The inlet side guiding member 33 is disposed with a tilt and serves to guide the recording paper 16 to a fixing nip portion 32 with which the heating roll 19 and the pressurizing belt 20 come in pressure contact. In an outlet portion positioned on a downstream side in a recording paper discharging direction of the fixing device 18, moreover, an outlet side lower guiding member 35 is provided on the heating roll 19 side of the fixing device 18. The outlet side lower guiding member 35 includes a plurality of convex members 34 for guiding the recording paper 16 passing through the fixing nip portion 32 to the discharging roll 21. The outlet side lower guiding member 35 is provided with a first plate portion 35*a*, a tilted portion 35*b* and a second plate portion 35*c* which are formed integrally by a heat-resistant synthetic resin, for example. As shown in FIGS. 1 and 5, the first plate portion 35*a* is disposed on the fixing nip portion 32 side of the fixing device 18, the tilted portion 35*b* is provided in a tilting state toward the downstream side in the recording paper delivering direction of the first plate portion 35*a*, and the second plate portion 35*c* is disposed on the downstream side in the recording paper delivering direction of the tilted portion 35*b*. As shown in FIG. 5, the convex members 34 formed to take an almost triangular shape at a side surface are disposed on a surface of the outlet side lower guiding member 35. They are provided at a predetermined interval in the direction crossing the recording paper delivering direction in a state in which they are protruded to a discharging delivering path 36 side of the recording paper 16 from the first plate portion 35*a*, the tilted portion 35*b* and the second plate portion 35*c*.

In the same manner as the outlet side lower guiding member 35, moreover, an outlet side upper guiding member 38 including a plurality of convex members 37 is provided in a position placed apart by a predetermined distance toward the downstream side in the recording paper delivering direction of the fixing nip portion 32 at the pressurizing belt 20 side (an upper side in FIG. 1) of the fixing device 18 so as to be opposed to the outlet side lower guiding member 35 through the discharging delivering path 36 for the recording paper 16 as shown in FIG. 1.

As shown in FIGS. 1 and 4, the outlet side upper guiding member 38 is formed integrally with a lower surface of an upper cover 39 for covering the upper end face of the fixing unit 30. The upper cover 39 can be freely opened/closed or attached/removed to/from the fixing unit 30 in such a manner that the discharging delivering path 36 for the recording paper 16 is exposed to an outside to enable a removal of the recording paper 16 with which the discharging delivering path 36 is jammed as shown in FIG. 5.

Figure 6:
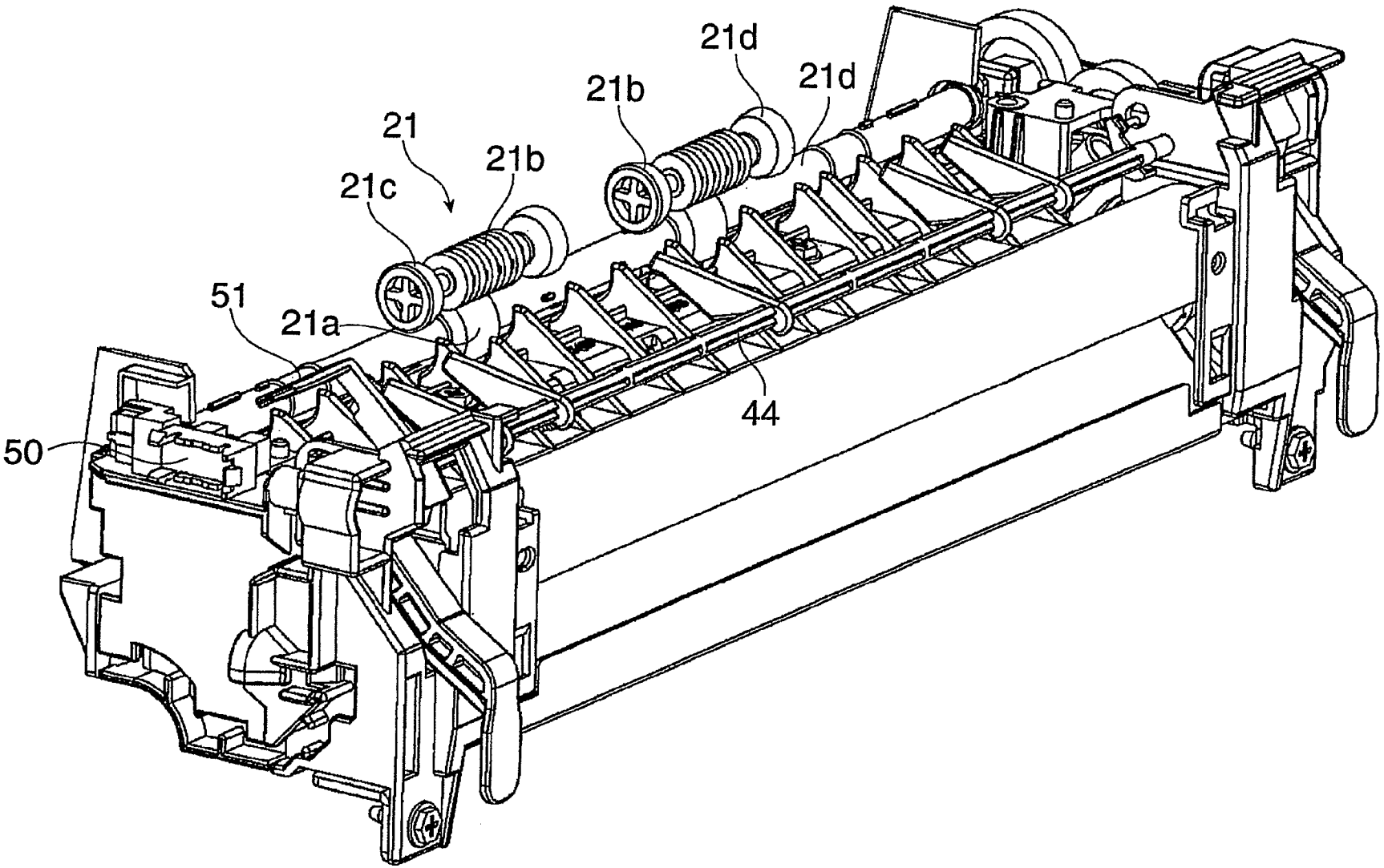
FIG. 6 is a perspective view showing the appearance of the fixing unit.

The recording paper 16 passing through the fixing nip portion 32 of the fixing device 18 is guided to the discharging roll 21 through the discharging delivering path 36 as shown in FIG. 1. In that case, a lower surface of the recording paper 16 is guided by means of the convex members 34 of the outlet side lower guiding member 35 as shown in FIGS. 1 and 5, and furthermore, an upper surface thereof is guided by means of the convex members 37 of the outlet side upper guiding member 38 as shown in FIG. 1. Moreover, the discharging delivering path 36 is formed in such a manner that a width of a passage is gradually reduced toward the discharging roll 21 side, and an end on the discharging roll 21 side is disposed to be shifted toward a side of a lower discharging roll 21*a* which has a relatively larger diameter and is to be rotated and driven in a pair of upper and lower discharging rolls 21*a* and 21*b* (21*c*) as shown in FIG. 1. As shown in FIG. 6, the discharging roll 21 is constituted by the lower discharging roll 21*a* attached to a driving shaft 21*d* and rotated and driven, the upper discharging roll 21*b* to be driven and rotated in contact with the lower discharging roll 21*a*, and the auxiliary discharging roll 21*c* provided on both sides in an axial direction of the upper discharging roll 21*b*.

Figure 7:
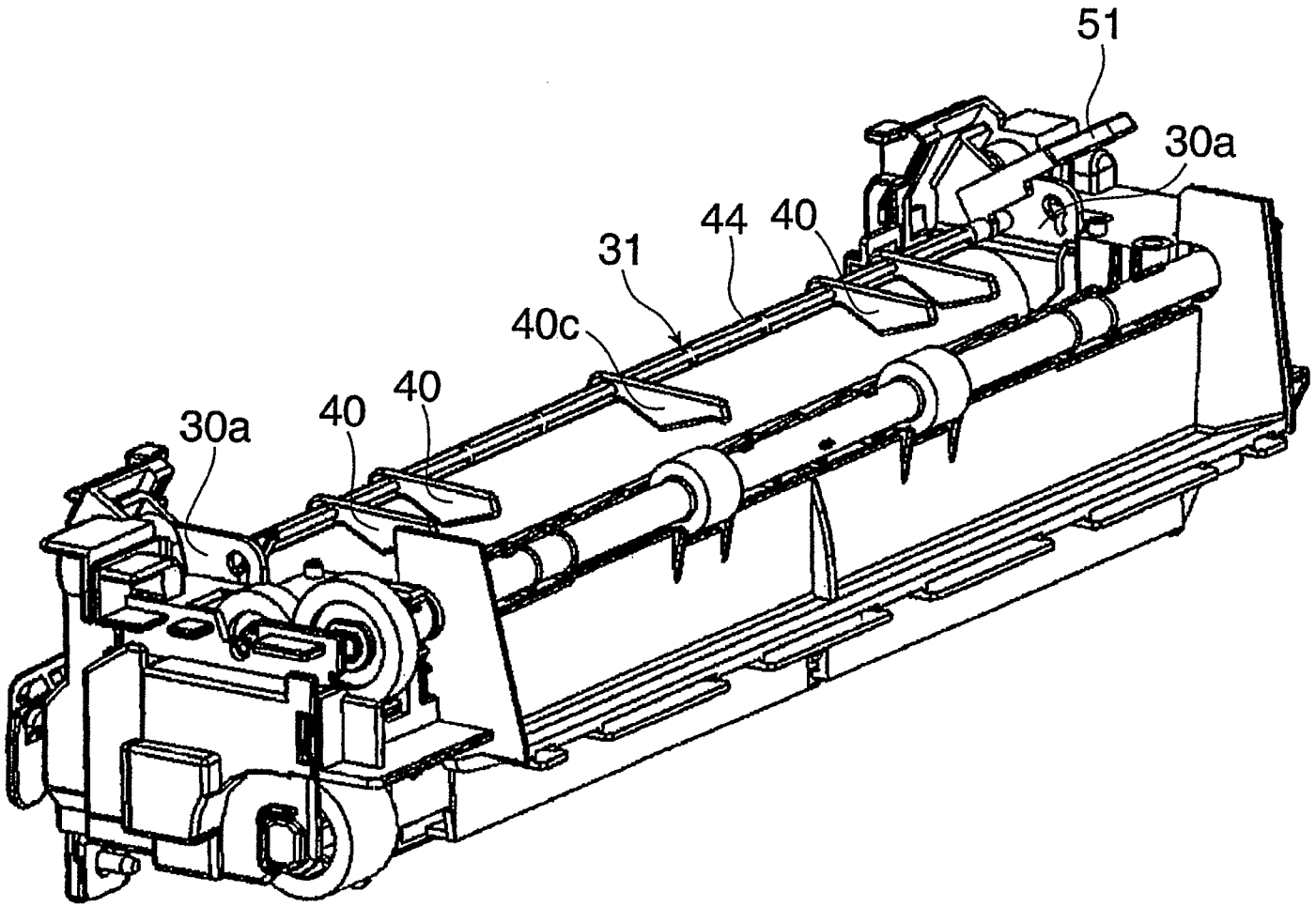
FIG. 7 is a perspective view showing the appearance of the fixing unit.

Moreover, the sheet pressing device 31 is provided in the outlet portion at the downstream side in the paper delivering direction of the fixing nip portion 32 of the fixing device 18 as shown in FIGS. 1, 5 and 7. The sheet pressing device 31 includes a plurality of pressing members 40 for pressing both ends in the direction along the surface of the recording paper 16 fixed by the fixing device 18 and the direction crossing the discharging direction.

As shown in FIG. 5, pressing members 40*a*, 40*a*, 40*b* and 40*b* are disposed two by two at the both end sides in the direction crossing the delivering direction of the recording paper 16 and the direction along the surface of the recording paper 16, and a single pressing member 40*c* is disposed in a central part thereof. In the embodiment shown in the drawing, five pressing members are disposed in total. Each of the pressing members 40 is formed by a slender plate-shaped member disposed in the direction crossing the surface of the recording paper 16 along the discharging direction of the recording paper 16 discharged from the fixing nip portion 32 of the fixing device 18. As a matter of course, the number of the pressing members 40 is not restricted to be five but may be smaller or larger.

Figure 8A:
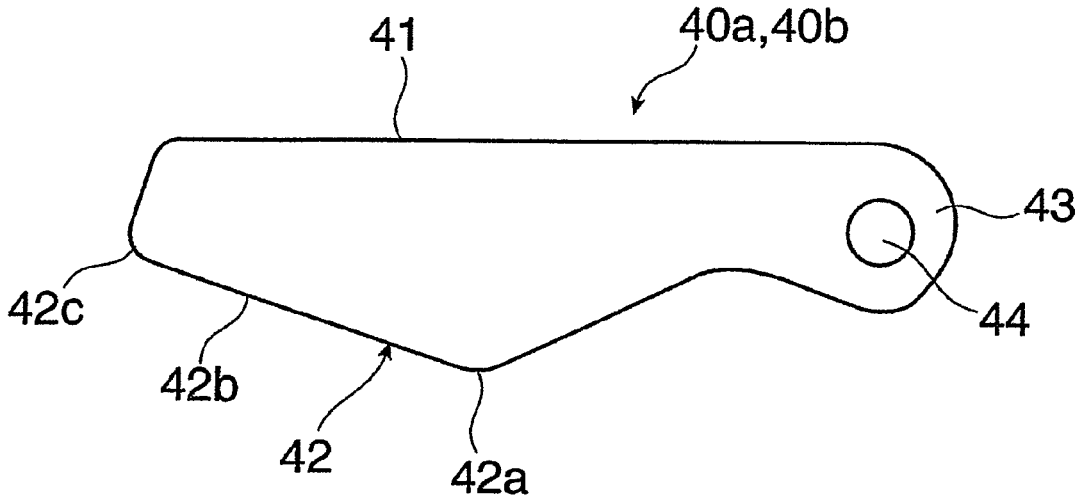
FIGS. 8A and 8B are front views showing a pressing member.

Although all of the five pressing members 40*a*, 40*a*, 40*b*, 40*b* and 40*c* are basically formed to take the same shapes, only a tip portion of the pressing member 40*c* disposed in the central part takes a different shape from that of each of the other pressing members 40*a*, 40*a*, 40*b* and 40*b*. In each of the four pressing members 40*a*, 40*a*, 40*b* and 40*b*, an upper end 41 is formed rectilinearly and a lower end 42 is formed to take an upward V shape as shown in FIG. 8A. In the lower end 42 of the pressing member, a portion 42*a* which is close to a central part in a longitudinal direction thereof is protruded downward and a tip portion 42*b* positioned on a tip side from the protruded portion 42*a* serves to guide the recording paper 16 in contact therewith. Moreover, a tip corner portion 42*c* formed to take an arcuate curved shape in the lower end 42 of the pressing member serves as a pressing portion for pressing both ends in the direction along the surface of the recording paper 16 and the direction crossing the discharging direction. Furthermore, a base end 43 of the pressing member is formed to take a curved shape which is close to an arcuate shape. The base end 43 is formed integrally with a rotating shaft member 44 serving as a holding member.

Figure 9:
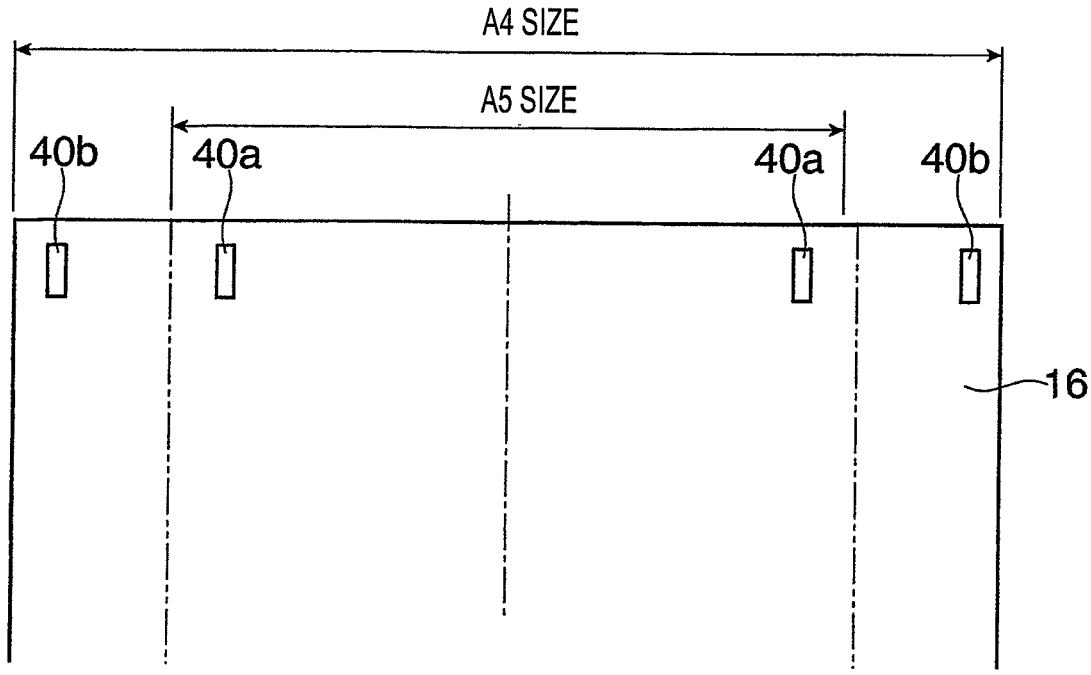
FIG. 9 is an explanatory view showing an arrangement of the pressing member.

As shown in FIG. 9, the two pressing members 40*a* and 40*a* positioned on an inside in the four pressing members 40*a*, 40*a*, 40*b* and 40*b* are disposed at a slightly smaller interval than a width in a short direction of the recording paper 16 having an A5 size, for example. Moreover, the two pressing members 40*b* and 40*b* positioned on an outside are disposed at a slightly smaller interval than a width in a short direction of the recording paper 16 having an A4 size, for example. As a matter of course, the intervals of the arrangement of the two sets of pressing members 40*a*, 40*a*, 40*b* and 40*b* may be caused to correspond to the recording paper 16 having other sizes.

Figure 8B:
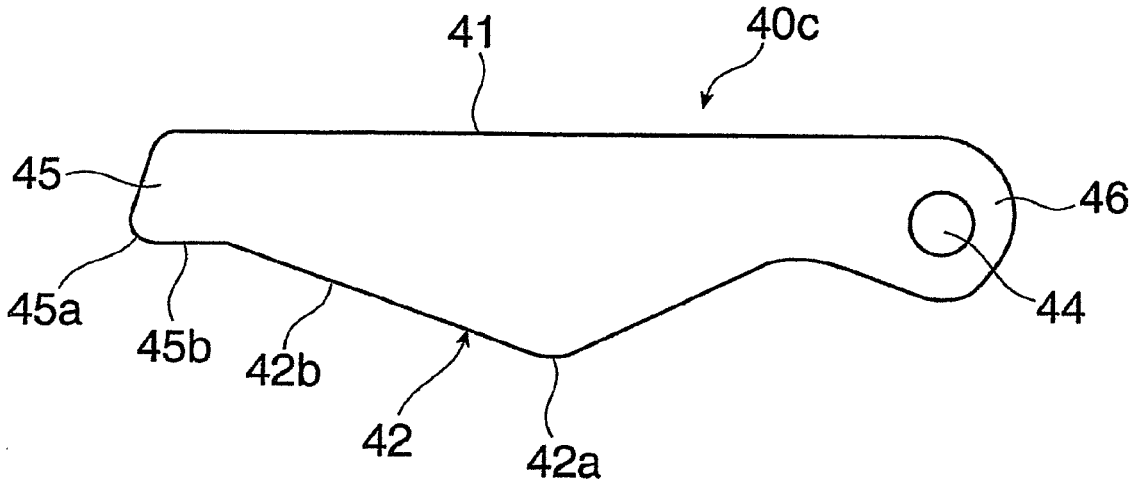

Although the central pressing member 40*c* is formed to take almost the same shape as that of each of the other pressing members 40*a*, 40*a*, 40*b* and 40*b* as shown in FIG. 8B, a tip portion 45 is set to be longer than that of each of the other pressing members 40*a*, 40*a*, 40*b* and 40*b*. In the central pressing member 40*c*, a corner part of the tip portion 45 is formed to take an arcuate curved shape. The pressing member 40*c* also serves as a detecting member of sheet detecting means for detecting the recording paper 16 discharged from the fixing device 18. Moreover, a lower end face 45*b* of the tip portion 45 in the pressing member 40*c* is formed to be continuously rectilinear with an obtuse angle formed with respect to a tip of the lower end 42, and is almost parallel with the upper end face 41. In addition, a base end 46 of the pressing member 40*c* is formed to take a curved shape which is close to an arcuate shape. The base end 46 is formed integrally with the rotating shaft member 44 serving as a holding member.

As shown in FIG. 1, the central pressing member 40*c* is disposed to be stopped in a state in which the tip portion 45 comes in contact with the surface of the first plate portion 35*a* in the outlet side lower guiding member 35. At this time, the lower ends 42 of the pressing members 40*a*, 40*a*, 40*b*, 40*b* and 40*c* are disposed to form an acute angle which is smaller than 90 degrees with respect to the convex members 34 of the outlet side lower guiding member 35. When the tip portion of the recording paper 16 comes in contact with the lower ends 42*b* of the pressing members 40*a*, 40*a*, 40*b* and 40*b*, the pressing members 40*a*, 40*a*, 40*b* and 40*b* are rotated and moved in a clockwise direction so that the recording paper 16 can smoothly pass therethrough. The pressing members 40*a*, 40*a*, 40*b* and 40*b* come in contact with the back side of the recording paper 16.

The pressing members 40*a*, 40*a*, 40*b*, 40*b* and 40*c* are disposed in the same position in a circumferential direction of the rotating shaft member 44, and are rotated and moved in the clockwise direction of FIG. 1 with a rotating operation of the rotating shaft member 44. The rotating shaft member 44 has both ends which are rotatably held by a side plate portion 30*a* of the fixing unit 30, and furthermore, is energized in a counterclockwise direction in FIG. 1 by means of a coil spring serving as energizing means which is not shown.

Moreover, an operating arm 51 is provided on one of ends in an axial direction of the rotating shaft member 44 so as to be extended in an almost L shape in the axial direction over an outer periphery of the rotating shaft member 44 as shown in FIG. 6. The operating arm 51 serves as a detecting member of a paper sensor 50 for detecting the recording paper 16 passing through the fixing device 18.

As shown in FIG. 6, the operating arm 51 is rotated and moved together with the rotating shaft member 44 to be rotated and moved with a rotating operation of the pressing members 40*a*, 40*a*, 40*b*, 40*b* and 40*c* and serves to bring the paper sensor 50 formed by a photointerrupter into a light receipt enabling state or a shading state, thereby detecting the passage of the recording paper 16.

With the structure, in a printer applying the sheet pressing member according to the embodiment, it is possible to prevent a failure such as a bend from being caused in a corner portion of a curved sheet without increasing a size of the apparatus also when a curving deformation occurs over a sheet subjected to a fixing treatment by a fixing device in a direction crossing a delivering direction thereof in the following manner.

More specifically, in the color printer, the toner images for the respective colors formed on the photosensitive drums 8Y, 8M, 8C and 8K of the image forming units 6Y, 6M, 6C and 6K for the yellow (Y), the magenta (M), the cyan (C) and the black (K) are primarily transferred sequentially onto the intermediate transfer belt 12 in a multiple way and are then transferred secondarily in a lump from the intermediate transfer belt 12 onto the recording paper 16 as shown in FIG. 2. Thereafter, the recording paper 16 having the toner images for the respective colors of the yellow (Y), the magenta (M), the cyan (C) and the black (K) transferred thereonto is delivered to the fixing device 18 so that the unfixed toner images are fixed onto the recording paper 16 in the fixing device 18.

Figure 10:
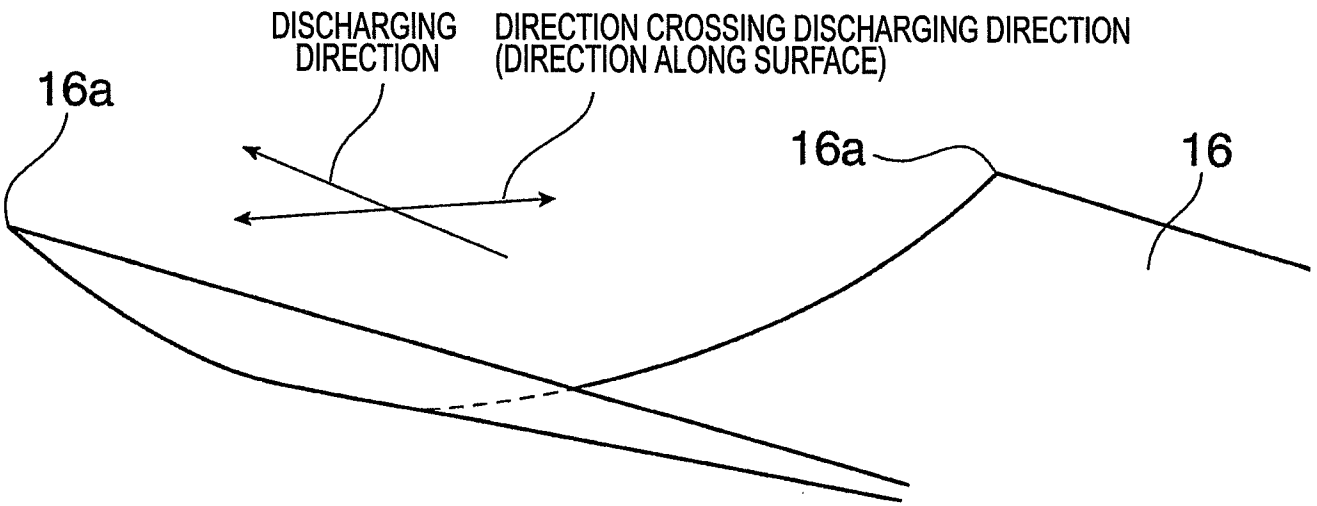
FIG. 10 is a typical view showing a deformation of a recording paper.

In that case, the recording paper 16 is heated and pressurized by means of the heating roll 19 to be rotated and driven and the pressurizing belt 20 to be driven and rotated in a pressure contact state with the heating roll 19 and is thus discharged from the fixing device 18. In some cases, however, there is caused a deformation referred to as a so-called "side curl" in which both ends 16*a* are curved upward (or downward) at a tip side in the direction crossing the delivering direction and the direction along the surface of the recording paper 16 over the recording paper 16 discharged from the fixing device 18 depending on a delivering property or a pressure distribution of the recording paper 16 in the fixing nip portion 32 or a moisture state of the recording paper 16 as shown in FIG. 10.

When the deformation referred to as the so-called "side curl" occurs over the recording paper 16 passing through the fixing device 18, consequently, the corner portion 16*a* of the tip portion in the discharging direction of the recording paper 16 comes in contact with the convex member 37 of the outlet side upper guiding member 28 provided on the outlet side of the fixing device 18 and is thus bent as shown in FIG. 1 so that there is caused a damage such as a bend like an ear of a dog which is referred to as a so-called dog ear.

In the embodiment, therefore, there is provided the sheet pressing device 31 including the pressing members 40*a*, 40*a*, 40*b*, 40*b* and 40*c* disposed on the downstream side in the discharging direction of the fixing device 18 and serving to press both ends in the direction crossing the delivering direction of the recording paper 16 subjected to the fixing treatment by the fixing device 18 and the direction along the surface of the recording paper 16, and the rotating shaft member 44 for supporting the pressing members 40*a*, 40*a*, 40*b*, 40*b* and 40*c* rockably in such a direction as to approach or separate from the surface of the recording paper 16 when the recording paper 16 passes therethrough as shown in FIG. 1.

As shown in FIGS. 1 and 4, the sheet pressing device 31 includes the pressing members 40*a*, 40*a*, 40*b*, 40*b* and 40*c* provided on the downstream side in the discharging direction of the fixing nip portion 32 of the fixing device 18 and serving to press the both ends in the direction crossing the delivering direction of the recording paper 16 subjected to the fixing treatment by the fixing device 18 and the direction along the surface of the recording paper 16.

Figure 11:
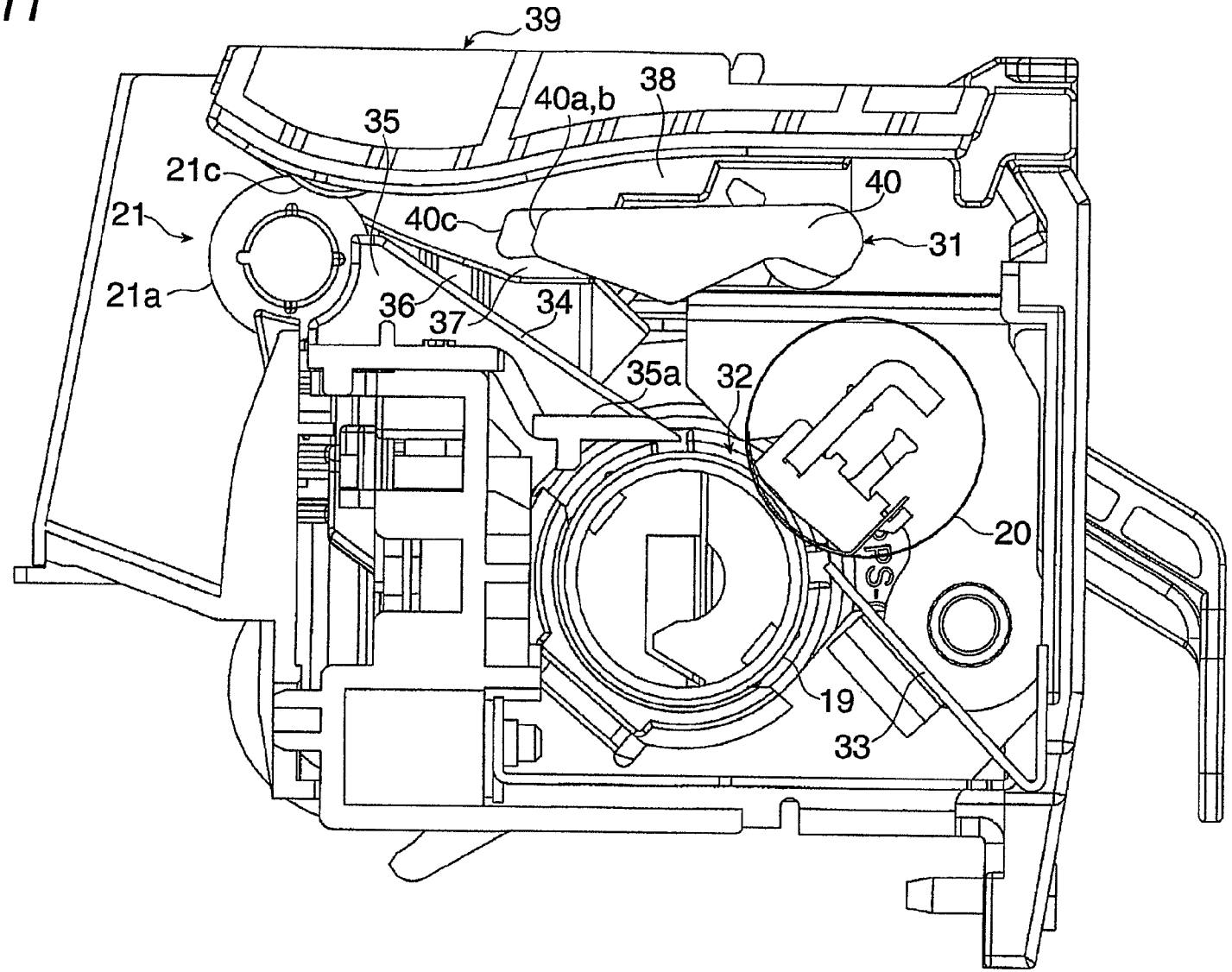
FIG. 11 is a view showing a sectional structure for an operation of the fixing unit applying the sheet pressing member according to the embodiment of the invention.

For this reason, as described above, the recording paper 16 causing the deformation 50 referred to as the so-called "side curl" in which the both ends 16*a* are curved upward (or downward) at the tip side in the direction crossing the delivering direction and the direction along the surface of the recording paper 16 is pressed by an energizing force or a deadweight of a coil spring (not shown) through the pressing members 40*a*, 40*a*, 40*b*, 40*b* and 40*c* which can be rotated and moved in the clockwise direction, and is pushed onto the convex member 34 of the outlet side lower guiding member 35 so that the deformation referred to as the side curl is suppressed and the recording paper 16 is thus delivered along the surface of the convex member 34 of the outlet side lower guiding member 35 in an almost close state to a plane as shown in FIG. 11.

Also in the case in which the deformation referred to as the side curl occurs over the recording paper 16, accordingly, it is possible to suppress the side curl of the recording paper 16 by the sheet pressing device 31. Therefore, it is possible to avoid the occurrence of the damage in which the corner portion 16*a* of the tip portion in the discharging direction of the recording paper 16 comes in contact with the convex member 37 of the outlet side upper guiding member 38 provided on the outlet side of the fixing device 18 and is thus bent, resulting in the bend into the ear of the dog which is referred to as the so-called dog ear.

Figure 12:
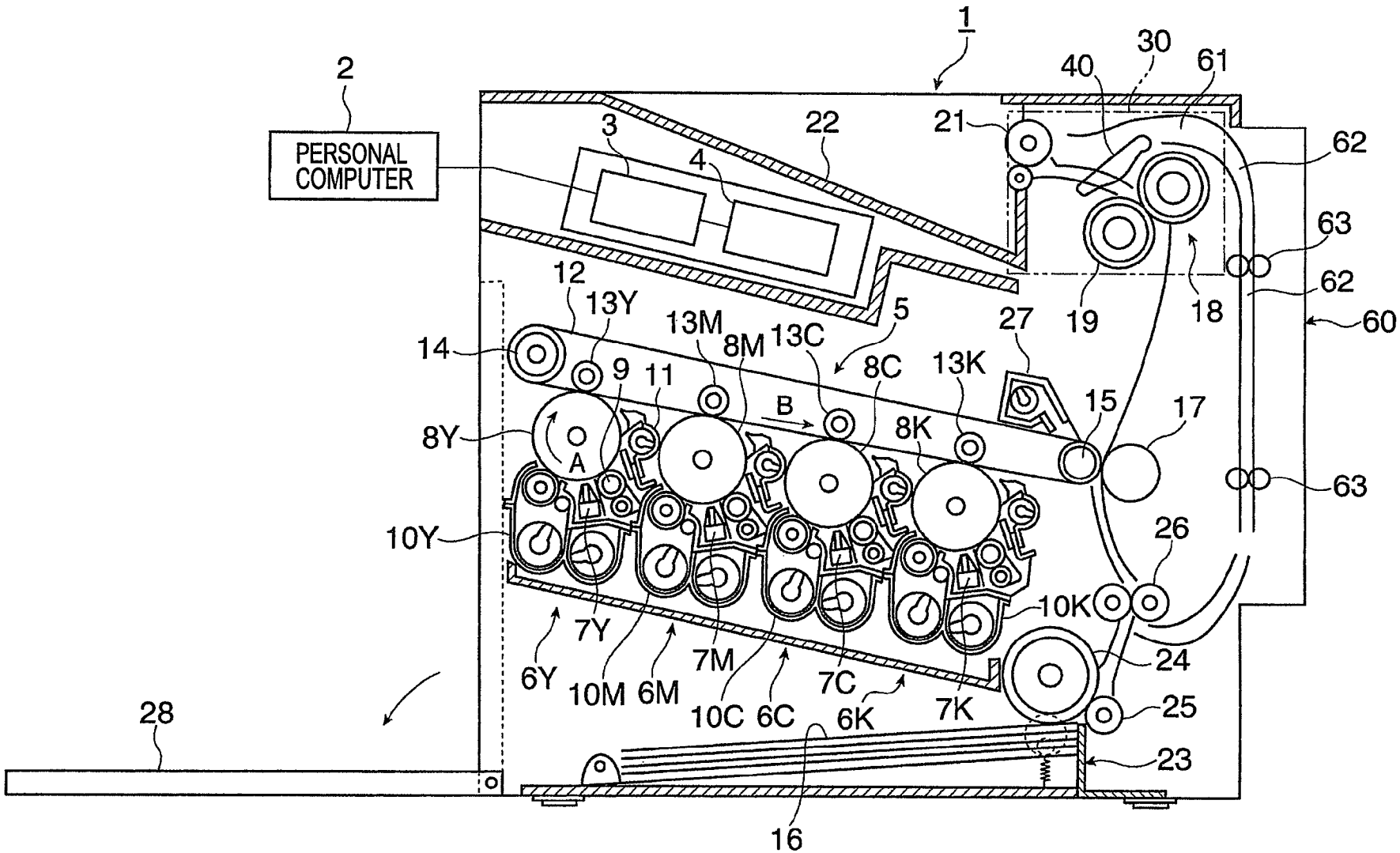
FIG. 12 is a view showing the structure of the color printer of the tandem type which serves as the image forming apparatus applying the sheet pressing device according to the embodiment of the invention.

FIG. 12 shows another embodiment according to the invention. Description will be given by attaching the same reference numerals to the same portions as those in the embodiment described above. In this embodiment, an image can be formed on both a surface and a back face of a sheet in addition to only the surface of the sheet.

More specifically, in this embodiment, there is employed a structure in which a double-sided paper delivering unit 60 can be freely attached/removed, as an option device, to/from a printer body 1 or is of another device type which is previously attached to the printer body 1 as shown in FIG. 12.

As shown in FIG. 12, the double-sided paper delivering unit 60 does not discharge a recording paper 16 having an image formed on one of sides by a fixing unit 30 onto a discharging tray 22 by means of a discharging roll 21 but a rotating direction of the discharging roll 21 is inverted and switching into a double-sided paper delivering path 61 provided above a fixing device 18 is carried out by means of a plurality of pressing members 40*a*, 40*a*, 40*b*, 40*b* and 40*c* servicing as a switching member which switches a delivering direction of the recording paper 16 while a rear end in a discharging direction of the recording paper 16 is held by the discharging roll 21.

Referring to the switching into the double-sided paper delivering path 61 through the pressing members 40*a*, 40*a*, 40*b*, 40*b* and 40*c*, it is sufficient that the pressing members 40*a*, 40*a*, 40*b*, 40*b* and 40*c* are stopped in a position shown in FIG. 12. The pressing members 40*a*, 40*a*, 40*b*, 40*b* and 40*c* may have a structure in which the recording paper 16 can be delivered to the double-sided paper delivering path 61 still more smoothly by rotating them in a slightly clockwise direction in FIG. 12 in addition to the position shown in FIG. 12 or forming an upper end 41 of each of the pressing members 40*a*, 40*a*, 40*b*, 40*b* and 40*c* to take an arcuate shape.

As shown in FIG. 12, moreover, the double-sided paper delivering unit 60 includes a double-sided paper delivering path 62 communicating with the double-sided paper delivering path 61, and a delivering roll 63 for delivering the recording paper 16 to a resist roll 26 is provided in the double-sided paper delivering path 62.

The recording paper 16 delivered to the resist roll 26 by the double-sided paper delivering unit 60 is fed to a secondary transfer position of an intermediate transfer belt 12 by means of the resist roll 26 with a surface and a back face inverted, an image is transferred and fixed onto the back face of the recording paper 16 and the recording paper 16 is then discharged onto the discharging tray 22 provided in an upper part of the printer body 1 by means of the discharging roll 21.

In that case, the pressing members 40*a*, 40*a*, 40*b*, 40*b* and 40*c* are stopped in the position shown in FIG. 1 by a coil spring serving as the energizing means (not shown) or a deadweight, and are rotated and moved in the clockwise direction of FIG. 12 by a delivering force of the recording paper 16 in a passage of the recording paper 16 so that the recording paper 16 is caused to pass with a correction of a side curl.

Since the other structures and functions are the same as those in the embodiment, description thereof will be omitted.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet pressing device comprising:

a plurality of pressing members that is provided on a downstream side in a discharging direction of a heating unit which carries out a heating treatment over a sheet along the discharging direction, and that presses both ends of the sheet on which the heating treatment has been carried out in a direction along a surface of the sheet and in a direction crossing the discharging direction;

a plurality of convex members that is provided on the downstream side in a discharging direction of the heating unit and guides the sheet along a surface of the sheet opposite to a surface of the sheet that is in contact with the plurality of pressing members, wherein the plurality of pressing members suppresses a deformation of the sheet by pushing onto the plurality of convex members at an outlet side lower guiding member; and a support member that supports the plurality of pressing members movably in such a direction as to approach or separate from the sheet when the sheet passes through the sheet pressing device, wherein the plurality of pressing members are plate-shaped members having an upper end and a lower end, wherein the lower end forms an upward V shape having a protruding portion, and wherein a tip portion positioned on a tip side from the protruding portion is in contact with the sheet, a portion of each of the plurality of pressing members which is to be contacted with the sheet is positioned at an upstream side, in the discharging direction, of a roll at a downstream side, in the discharging direction, of the heating unit, wherein the roll is a roll closest, in the discharging direction, to the heating unit, wherein a first surface of each of the pressing members is configured as part of a discharging delivering path for the sheet, and a second surface of each of the pressing members opposite to the second surface is configured as part of a double-sided image forming delivering path for the sheet when forming an image on both sides of the sheet, and wherein the plurality of pressing members are configured to switch from the discharging delivering path for the sheet to the double-sided image forming delivering path for the sheet by rotating.

2. The sheet pressing device according to claim 1, wherein a longest pressing member which is one of the plurality of pressing members is provided in such a manner that the longest pressing member is in contact with a center of a guiding member which guides the sheet, an operating arm is provided on one end of the support member, and the operating arm brings a photointerrupter light into a light receipt enabling state or a shading state in conjunction with rotating the pressing members when the longest pressing member abuts the sheet.

3. The sheet pressing device according to claim 1, wherein the plurality of pressing members are energized in such a direction as to abut on the surface of the sheet.

4. The sheet pressing device according to claim 1, wherein the plurality of pressing members are provided in a plurality of sets depending on a size of the sheet, two of the pressing members which are disposed on both ends of the sheet in the direction crossing the discharging direction of the sheet respectively making a set.

5. The sheet pressing device according to claim 1, wherein an operating arm is provided on one end of the support member, the operating arm brings a photointerrupter light into a light receipt enabling state or a shading state in conjunction with rotating the pressing members when the longest pressing member abuts the sheet, and the operating arm is provided at an end portion of the support member and in a rotation axis direction of the support member.

6. An image forming apparatus comprising:

a heating unit that carries out a heating treatment over a sheet along a discharging direction;

a plurality of pressing members that are provided on a downstream side in the discharging direction of the heating unit, and that presses both ends of the sheet on which the heating treatment has been carried out in a direction along a surface of the sheet and in a direction crossing the discharging direction;

a plurality of convex members that is provided on the downstream side in a discharging direction of the heating unit and guides the sheet along a surface of the sheet opposite to a surface of the sheet that is in contact with the plurality of pressing members, wherein the plurality of pressing members suppresses a deformation of the sheet by pushing onto the plurality of convex members at an outlet side lower guiding member; and a support member that supports the plurality of pressing members movably in such a direction as to approach or separate from the sheet when the sheet passes through the image forming apparatus, wherein the plurality of pressing members are plate-shaped members having an upper end and a lower end, wherein the lower end forms an upward V shape having a protruding portion, and wherein a tip portion positioned on a tip side from the protruding portion is in contact with the sheet, a portion of each of the plurality of pressing members which is to be contacted with the sheet is positioned at an upstream side, in the discharging direction, of a roll at a downstream side, in the discharging direction, of the heating unit, wherein the roll is a roll closest, in the discharging direction, to the heating unit, wherein an image can be formed on both sides of the sheet, wherein a first surface of each of the pressing members is configured as part of a discharging delivering path for the sheet, and a second surface of each of the pressing members opposite to the first surface is configured as part of a double-sided image forming delivering path for the sheet when forming an image on both sides of the sheet, and wherein the plurality of pressing members are configured to switch from the discharging delivering path for the sheet to the double-sided image forming delivering path for the sheet by rotating.

7. The image forming apparatus according to claim 6, wherein an operating arm is provided on one end of the support member, the operating arm brings a photointerrupter light into a light receipt enabling state or a shading state in conjunction with rotating the pressing members when the longest pressing member abuts the sheet, and the operating arm is provided at an end portion of the support member and in a rotation axis direction of the support member.

* * * * *